United States Patent [19]

Leichle et al.

[11] Patent Number: 4,802,247

[45] Date of Patent: Feb. 7, 1989

[54] DOOR BATH TUBE FOR THE HANDICAPPED

[76] Inventors: Roland G. Leichle, 1, chemin du Baron, Cirey sur Vezouze, France, 54480; Jean-Paul Lecrivain, 9, Allée Belle Vue, Luneville Chanteheux, France, 54300

[21] Appl. No.: 894,093

[22] Filed: Aug. 8, 1986

Related U.S. Application Data

[63] Continuation of Ser. No. 694,516, filed as PCT FR84/00090 on Apr. 3, 1984, published as WO84/04236 on Nov. 8, 1984, abandoned.

[30] Foreign Application Priority Data

Apr. 28, 1983 [FR] France ..... 83 07027

[51] Int. Cl.[4] ..... A47K 3/02

[52] U.S. Cl. ..... 4/556; 49/255; 16/360; 16/361

[58] Field of Search ..... 4/555–557, 4/607, 610; 49/254, 255, 463; 16/50, 360, 361, 370, 302, 297, 348

[56] References Cited

U.S. PATENT DOCUMENTS

| | | | |
|---|---|---|---|
| 695,836 | 3/1902 | Rhodes | 49/463 |
| 1,416,651 | 5/1922 | Lanfair | 49/255 |
| 1,529,524 | 3/1925 | Wilbur | 49/255 |
| 2,991,482 | 7/1961 | Brass | 4/556 |
| 3,416,166 | 12/1968 | Hanson | 4/555 |
| 3,863,275 | 2/1975 | Brendgord et al. | 4/556 |
| 4,112,524 | 9/1978 | Johansson | 4/560 |
| 4,360,935 | 11/1982 | Barrett, Sr. | 4/556 |

FOREIGN PATENT DOCUMENTS

| | | | |
|---|---|---|---|
| 2434617 | 8/1978 | France . | |
| WO81/02387 | 9/1981 | World Int. Prop. O. | 4/556 |

*Primary Examiner*—Henry J. Recla
*Assistant Examiner*—Linda J. Sholl
*Attorney, Agent, or Firm*—Renner, Kenner, Greive, Bobak, Taylor & Weber

[57] ABSTRACT

Bath tub comprising a side wall openable towards the outside by pivoting about a hinge having a vertical axis to provide an aperture for opening to access the bath tub, characterized in that the width of the opening, measured horizontally, continuously increases from bottom to top, in that the contour of the opening on the wall of the body of the bath tub has a fillister turned towards the inside of the bath tub, in that the contour cooperating with the door has a complementary fillister turned towards the outside of the bath tub, a sealing joint being provided between both fillisters, and in that the door is fitted with a handle and with a mechanism capable, under the action of the operating handle, to lift the door from its low closed position to vertically disengage both fillisters from each other at least in their remote articulation area and enable the free opening pivoting of the door towards the outside.

15 Claims, 4 Drawing Sheets

DOOR BATH TUBE FOR THE HANDICAPPED

This application is a continuation of application Ser. No. 06/694,516, filed as PCT FR84/00090 on Apr. 3, 1984, published as WO84/04236 on Nov. 8, 1984, now abandoned.

The present invention relates to bath-tubs with a seat for motive disabled persons, a side wall of which having a cut-out part, or bay, extending over the whole height of said wall and which is provided with a tight mobile closing panel equipped with locking means for the closed position, said locking means being accessible from the outside as well as from the inside of the bath-tub.

This type of bath-tub, due to the presence of the side cut-out part, offers the great advantage that the patient can get inside transversely with his own means.

A bath-tub of the type comprising improving means for the operation and locking of the door and for the relative arrangement of the door and the seat is already known by French Pat. No. 2.434.617 of Aug. 30, 1978.

The object of the present invention is to provide further improvements, aimed this time at the operation mode of the door and at the cooperation of said door with the bath-tub body.

The bath-tub according to the invention, which includes a side door adapted for being opened outwardly by tilting about an articulation of vertical axis for clearing a cut-out part or access bay into the bath-tub, is characterized by the fact that the width of the cut-out part, measured horizontally, increases continuously from the bottom to the top, that the contour of the cut-out part on the wall of the bath-tub body has a rabbet turned inwardly to the bath-tub, that the cooperating door contour has a complementary rabbet turned outwardly from the bath-tub, a seal being provided between the two rabbets, and in that the door is provided with an operating handle and with a mechanism adapted, under the action of the operating handle, for lifting the door from its lower closed position for vertically disengaging the two rabbets from each other at least in their regions which are remote from the articulation and for allowing the free opening pivoting movement of the door outwardly.

According to a preferred embodiment, the mechanism bears against a member articulated about the same axis as that about which the door is articulated on the bath-tub body.

Preferably, at least the lower edge of the cut-out part of the bath-tub body, substantially horizontal, is formed as a V-shaped groove in which fits the lower edge of the door, with its sealing portion, for providing the locking of the door in its closed position, thereby making useless the traditional lock formed of a protruding rod or horizontal bolt adapted for extending into the bath-tub body.

Figure 1:
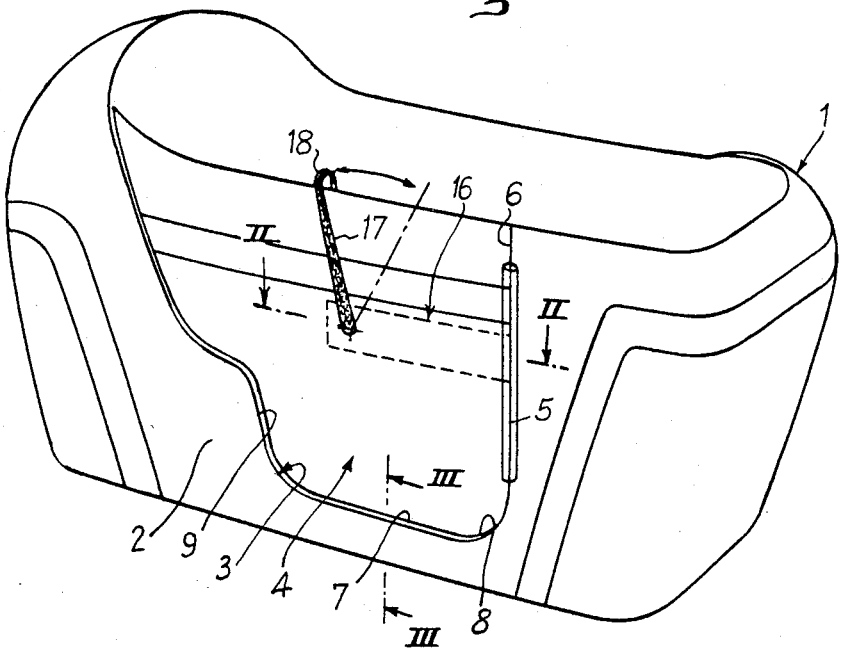
Figure 3:
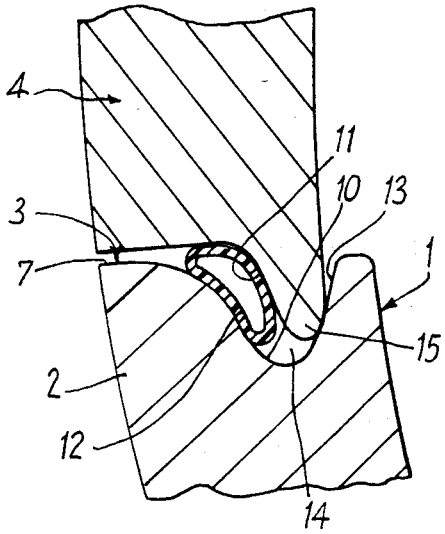
Figure 2:
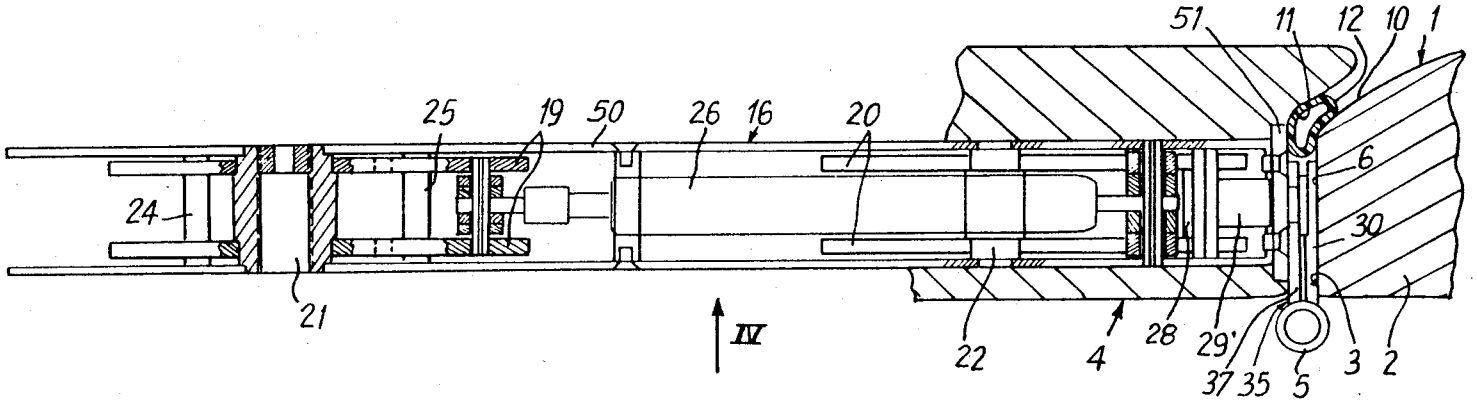
Figure 4:
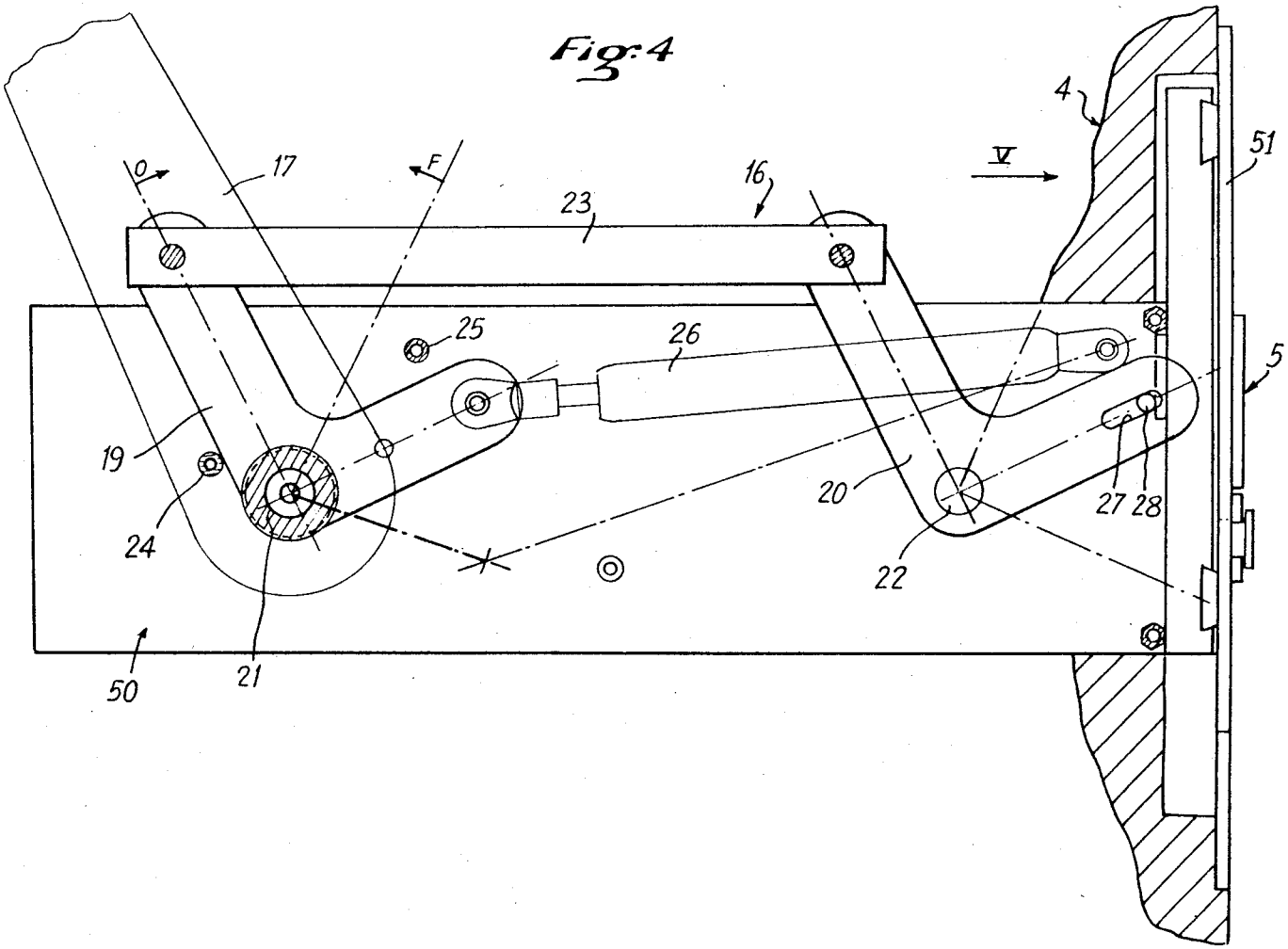
Figure 5:
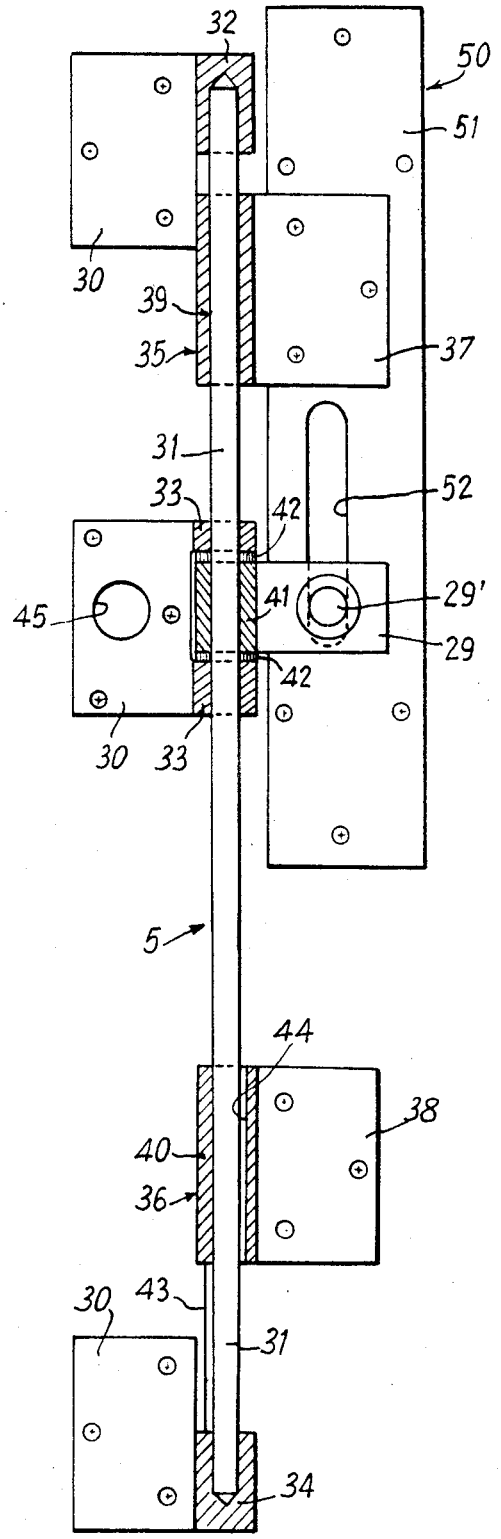

Further features of the invention will become apparent from the following description, with reference to the accompanying drawings wherein:

FIG. 1 is a perspective view of the bath-tub according to the invention,

FIG. 2 is a sectional view along line II—II of the bath-tub of FIG. 1, the operating lever being omitted, FIG. 3 is a sectional view along line III—III of the bath-tub of FIG. 1, FIG. 4 is a view as seen in the direction of arrow IV of FIG. 2, and FIG. 5 is a view of the articulation means of the door on the bath-tub body, in the direction of arrow V of FIG. 4, and for the position of the door opened over 180°.

The bath-tub for motive disabled persons shown in FIG. 1 comprises a bath-tub body 1 including, in known manner, a seat (not shown). One of the side walls 2 of the bath-tub is formed with a wide cut-out part 3 opening into the upper edge and which can be masked by a door 4, of matching contour, adapted for tilting outwardly when being opened and mounted about an articulation 5 of vertical axis off-set to the outside.

Portion 6 of the cut-out part 3 which is adjacent the articulation is vertical; the lower portion 7 of the cut-out part is substantially horizontal and connected to the vertical portion by a concave connecting portion 8; the remaining portion 9 of the cut-out part is profiled and flared out to the upper edge of the bath-tub. The width of the cut-out part, measured horizontally, viz. perpendicularly to the articulation axis 5, increases continuously from bottom to top. In other words, at any point of the cut-out part contour, the tangent to the contour has, on each side, an angle of same sign with respect to the horizontal. Therefore, the contour can be concave at all points, but it can also have inflection points for giving rise to convex portions, as shown in FIG. 1 for the passage of the seat.

The edge of the cut-out part 3 presents a curved continuous rabbet 10 turned inwardly to the bath-tub, while the cooperating edge of the door 4 has a matching curved continuous rabbet 11 which is turned outwardly from the bath-tub and carries a continuous seal 12 formed for example of a elastomeric tubular bead glued onto the rabbet 11. As shown in FIGS. 2 and 3, seal 12 is squeezed between rabbets 10, 11 due to the matching sections of the latter. On the other hand, the tightness provided by the seal pressed against the bath-tub body from the inside towards the outside is reinforced by the water pressure acting on the door in the same direction.

For providing the tightness from the very beginning of the filling operation of the bath-tub, the lower edge of the cut-out part 3, viz. portion 7, comprises a rabbet 13 turned outwardly, so as to define with the adjacent rabbet portion 10 a lower V-shaped groove 14 adapted for receiving the lower edge 15 of the door 4 and for firmly biasing it outwardly in order to press the corresponding portion of seal 12 against rabbet 10.

Eventually, such a V-shaped groove can extend on the sides, beyond the lower edge of the cut-out part, on the whole or only on a portion of the contour of the latter.

When observing FIGS. 1, 2 and 3, one can see that from its closed position which is shown, the door cannot be opened by a simple tilting motion about articulation 5.

The bath-tub according to the invention therefore comprises a mechanism 16 allowing the operator lifting the door before opening it.

The operation of the door is carried out, as in the hereabove mentioned patent application, with the assistance of a single tilting lever 17 the upper end 18 of which has the shape of a club so as to ride over the upper edge of door 4 and which can move in a vertical plane while remaining substantially outside the door in which it penetrates at its lower pivoting end.

Mechanism 16 is imbedded in door 4. It is carried by a frame 50 appropriately fixed to the door body. It includes two bent levers 19, 20 of same geometry, located in a vertical plane. Lever 19 is rigidly connected to the operating lever 17 articulated on the door body about a transverse pivot 21. Lever 20 is articulated on the door body about a transverse pivot 22. The bent levers are coupled by a tierod 23 of same length as the distance between the axes of pivots 21, 22 so that, for a connection of a deformable parallelogram type, levers 19, 20 perform the same tilting motion.

The extreme angular positions of operating lever 17 are defined by two abutments 24, 25 rigidly fixed to the door body and acting on the bent lever 19. A return device 26 of the type moving beyond a neutral point, of mechanical or pneumatic nature, biases the operating lever 17 towards one or the other of the extreme positions, on either side of an unstable mean position.

The branch of bent lever 20 which is remote from tie-rod 23 is adjacent the articulation 5 and is formed with an elongated slit 27 receiving a transverse spindle 28 mounted at the end of a horizontal rod 29' screwed onto a vertical plate 29 which can rotate with door 4 about the axis of articulation 5 but which is vertically fixed. Rod 29' extends into the vertical edge of the door and through the end vertical plate 51 of frame 50 through a vertical slit 52 allowing a relative vertical motion between the door and the assembly 28, 29, 29'.

The vertical edge of the bath-tub body 1 receives fixedly, in the region of articulation 5, three fixed hinge elements 30 supporting a vertical rod 31, forming a pivot, through an upper 32, intermediate 33 and lower 34 sleeves. In turn, the vertical edge facing door 4 and/or the frame plate 51 receive fixedly two hinge mobile elements 35, 36 adapted for vertically sliding and for rotating with respect to rod 31. The mobile hinge elements 35, 36 include respectively a plate 37, 38 fixed to the door and a sleeve 39, 40 surrounding rod 31.

Between sleeves 33 is arranged a sleeve 41 which carries the plate 29 supporting rod 29' and spindle 28. The installation 28, 29', 29, 41 rotates with the door about rod 31. Its is maintained in a fixed vertical position due to it being captured between the two spaced intermediate sleeves 33, which are in turn fixed. The plate 30 is formed with an opening 45 for receiving rod 29' when in the closed position. Bronze rings 42 are placed on either side of sleeve 41 on rod 31. They promote the pivoting and form possibly height adjusting blocks.

The mobile hinge elements 35, 36 are situated respectively between sleeves 32, 33 and sleeves 33, 34. For the bottom position of the door, said mobile hinge elements are in abutment against at least one of sleeves 33, 34, thereby corresponding to the position of the bent lever 19 coming to bear against the stoke end abutment 24.

The operation of the door is the following. Starting from the lower closed position of the door, the operator tilts the operating lever to the right (FIG. 4) against the action of device 26 and the weight of the door, thereby tilting clockwise the bent lever 20. During this motion, lever 20, as well as the whole door assembly, bears on spindle 28 and therefore on the installation 29', 29, 41 which, in turn, bears against one fixed sleeve 33. Thereby is provided the lifting of the door, which disengages the door from rabbet 10 on the cut-out part 3 in regions 7, 8 and 9. In the region of articulation 5, there is no disengagement, but this is no hindrance since the axis of articulation 5 is outside and the rabbets move apart by themselves during the tilting motion.

Then, the door can be freely opened by being tilted.

In order to close the door, one procedes in the reverse manner: the door is tilted to its closed position, then the operating lever 17 is actuated, which brings the door down and the plate against the bath-tub body, with the assistance of the return device 26 which presses firmly seal 12.

In the opened position, the door 4 is maintained by itself in a high position due to the friction and the return device 26 exceeding a neutral point, the force of which is calculated so as to overcome the weight of the door and any attempt for bringing the door down into a closed position by a weighting action on the door. In any case, such a downward displacement does not risk damaging the bath-tub body or the door if the latter is completely opened; but for an incompletely closed positions of the door, its untimely lowering due to a premature operation of lever 17 could cause such a damage. It is the reason why, according to a further feature of the invention, means are provided so that the door can only be lowered when it is in its closed angular position and can be tilted only when it is in its upper position. Advantageously, said means are made of matching non circular profiles of a portion of rod 31 and of at least one of the mobile sleeves 39, 40. For example, and as shown in FIG. 5, rod 31 carries in its lower portion, at the height of the sleeve, an axial key 43 and sleeve 30 is formed over its whole height with a complementary axial groove 44 situated in an angular region such that it is vertically in register with key 43 only in the closed position of the door.

Of course, various modifications could be carried out without departing from the scope of the invention, notably by arranging mechanism 16 in a different manner, for example by including it in a pinion and rack system for the vertical displacement of the door.

We claim:

1. A bath-tub with a door for motive disabled persons, which includes a side door (4) adapted for being opened outwardly by tilting about an articulation (5) of vertical axis for clearing a cut-out part or access bay into the bath-tub, is characterized by the fact that the width of the cut-out part (3), measured horizontally, increases continously from the bottom to the top, that the contour of the cut-out part (3) on the wall of the bath-tub body (1) has a rabbet (10) turned inwardly to the bath-tub, that the cooperating contour of door (4) has a complementary rabbet (11) turned outwardly from the bath-tub, a seal (12) being provided between the two rabbets, and in that the door is provided with an operating handle (17) and with a mechanism (16) adapted, under the action of the operating handle, for lifting the door from its lower closed position for vertically disengaging the two rabbets from each other at least in their region which are remote from the articulation and allowing the free opening pivoting movement of the door outwardly.

2. A bath-tub according to claim 1, wherein mechanism (16) bears, for the vertical displacement of the door, onto a member (29, 41) rotating with the door about said articulation (5), but vertically movable with respect to the door.

3. A bath-tub according to claim 1, wherein articulation (5) comprises fixed hinge elements (30, 32, 33, 34) rigidly connected to the bath-tub, a fixed vertical rod (31) carried by said fixed hinge elements, and mobile hinge elements (35, 36) rigidly connected to the door and adapted for vertically sliding and for rotating with respect to the rod.

4. A bath-tub according to claim 1, wherein at least the lower edge (7) of the cut-out part (3) of the bath-tub body is substantially horizontal and has the shape of a V-shaped groove (14) in which fits the lower edge (15) of the door, with its seal portion (16), for providing the locking of the door when in the closed position.

5. A bath-tub according to claim 1, wherein the operating mechanism comprises tilting levers (19, 20) actuated by the operating handle (17).

6. A bath-tub according to claim 1, wherein the operating mechansim comprises return means (26) for biasing said operating handle towards one or the other of the positions producing the upper and lower positions of the door.

7. A bath-tub according to claim 1, characterized by the fact that it comprises means (43, 44) for preventing the tilting of the door when in its lower position and its lowering when in an angular position not completely closed.

8. A bath-tub according to claim 7, characterized by the fact that said means (43, 44) are made of matching profiles of fixed parts and of vertically and rotatably movable parts of articulation (5), said profiles being in vertical alignment only for the angular closed position of the door.

9. A bath-tub with a door for motive disabled persons, which includes a side door adapted for being opened for clearing a cut-out part or access bay into the bath-tub, characterized by the fact that the width of the cut-out part, as measured horizontally, increases continuously from the bottom to the top, that the contour of the cut-out part on the wall of the bath-tub body has an inwardly directed rabbet, and that the cooperating contour of the door has a complementary outwardly directed rabbet, and that a seal is provided between said inwardly directed rabbet and said outwardly directed rabbet, whereby the door can be opened from its lower closed position by an upwardly directed movement for disengaging the cooperating complementary rabbets and including lifting means for raising the door from its lower closed position for vertically disengaging said rabbets from each other to allow free opening movement of the door outwardly, said lifting means bears, for the upward movement of the door, onto a member vertically movable with respect to the door.

10. A bath-tub with a door for motive disabled persons, which includes a side door adapted for being opened for clearing a cut-out part or access bay into the bath-tub, characterized by the fact that the width of the cut-out part, as measured horizontally, increases continuously from the bottom to the top, that the contour of the cut-out part on the wall of the bath-tub body has an inwardly directed rabbet, and that the cooperating contour of the door has a complementary outwardly directed rabbet, and that a seal is provided between said inwardly directed rabbet and said outwardly directed rabbet, whereby the door can be opened from its lower closed position by an upwardly directed movement for disengaging the cooperating complementary rabbets and including lifting means for raising the door from its lower closed position for vertically disengaging said rabbets from each other to allow free opening movement of the door outwardly, said lifting means includes tilting levers joined by a tie rod.

11. A bath-tub with a door for motive disabled persons, which includes a side door adapted for being opened for clearing a cut-out part or access bay into the bath-tub, characterized by the fact that the width of the cut-out part, as measured horizontally, increases continuously from the bottom to the top, that the contour of the cut-out part on the wall of the bath-tub body has an inwardly directed rabbet, and that the cooperating contour of the door has a complementary outwardly directed rabbet, and that a seal is provided between said inwardly directed rabbet and said outwardly directed rabbet, whereby the door can be opened from its lower closed position by an upwardly directed movement for disengaging lifting means for raising the door from its lower closed position for vertically disengaging said rabbets from each other to allow free opening movement of the door outwardly, said lifting means includes return means for biasing the door towards one or the other positions producing the upper and lower positions of the door.

12. A bath-tub with a door for motive disabled persons, which includes a side door adapted for being opened for clearing a cut-out part or access bay into the bath-tub, characterized by the fact that the width of the cut-out part, as measured horizontally, increases continuously from the bottom to the top, that the contour of the cut-out part on the wall of the bath-tub body has an inwardly directed rabbet, and that the cooperating contour of the door has a complementary outwardly directed rabbet, and that a seal is provided between said inwardly directed rabbet and said outwardly directed rabbet, whereby the door can be opened from its lower closed position by an upwardly directed movement for disengaging the cooperating complementary rabbets and including articulation means having a vertical pivot axis for the opening of the door outwardly.

13. A bath-tub according to claim 12, including means for preventing pivoting of the door when in its lower position and its lowering when in an angular outwardly open position not completely closed.

14. A bath-tub according to claim 13, wherein said means for preventing pivoting of the door include profiles of fixed parts and of vertically and rotatably movable parts of said articulation means, said profiles being in vertical alignment only for the closed angular position of the door.

15. A bath-tub with a door for motive disabled persons, which includes a side door adapted for being opened for clearing a cut-out part or access bay into the bath-tub characterized by the fact that the width of the cut-out part, as measured horizontally, increases continuously from the bottom to the top, that the contour of the cut-out part on the wall of the bath-tub body has an inwardly directed rabbet, and that the cooperating contour of the door has a complementary outwardly directed rabbet, and that a seal is provided between said inwardly directed rabbet and said outwardly directed rabbet, whereby the door can be opened from its lower closed position by an upwardly directed movement for disengaging the cooperating complementary rabbets and including articulation means comprising fixed hinge elements rigidly connected to the bath-tub, a fixed vertical rod carried by said fixed hinge elements, and mobile hinge elements rigidly connected to the door and adapted for vertically sliding and for rotating with respect to the rod.

* * * * *